US007261367B2

(12) United States Patent
Duncan et al.

(10) Patent No.: US 7,261,367 B2
(45) Date of Patent: Aug. 28, 2007

(54) METHOD AND APPARATUS FOR A THREE POSITION WALL-AVOIDING RECLINING CHAIR

(76) Inventors: Robert Barron Duncan, 3700 Eagle Pl., Suite 100, Dallas, TX (US) 75236; Javier Enriquez, 2209 Western Park, Dallas, TX (US) 75211; Enrico Panceri, 525 Westchester Pkwy., Grand Prairie, TX (US) 75052; Douglas L. Gasal, 9136 Dunmore Pl., Dallas, TX (US) 75231; W. Clark Rogers, P.O. Box 722, Badin Lake, Denton, NC (US) 27239

( * ) Notice: Subject to any disclaimer, the term of this patent is extended or adjusted under 35 U.S.C. 154(b) by 669 days.

(21) Appl. No.: 10/380,724

(22) PCT Filed: Sep. 5, 2001

(86) PCT No.: PCT/US01/27666

§ 371 (c)(1),
(2), (4) Date: Aug. 25, 2003

(87) PCT Pub. No.: WO02/21973

PCT Pub. Date: Mar. 21, 2002

(65) Prior Publication Data

US 2004/0051350 A1 Mar. 18, 2004

(51) Int. Cl.
*A47C 1/02* (2006.01)

(52) U.S. Cl. ..... 297/68; 297/83; 297/184.14

(58) Field of Classification Search ..... 297/68, 297/83, 85, 188.14
See application file for complete search history.

(56) References Cited

U.S. PATENT DOCUMENTS

| | | | | |
|---|---|---|---|---|
| 2,973,027 | A | | 2/1961 | Navell et al. |
| 3,100,668 | A | | 8/1963 | Rogers et al. |
| 3,370,884 | A | | 2/1968 | Rogers, Jr. |
| 3,400,975 | A | | 9/1968 | Rogers, Jr. |
| 3,537,747 | A | | 11/1970 | Rogers, Jr. |
| 3,652,125 | A | | 3/1972 | Rogers, Jr. |
| 3,730,585 | A | | 5/1973 | Rogers, Jr. et al. |
| 3,743,348 | A | * | 7/1973 | Sloan ..... 297/83 X |
| 3,767,257 | A | | 10/1973 | Rogers, Jr. et al. |
| 3,768,859 | A | | 10/1973 | Rogers, Jr. et al. |
| 3,815,954 | A | | 6/1974 | Rogers, Jr. et al. |
| 3,865,432 | A | | 2/1975 | Rogers, Jr. et al. |
| 3,904,240 | A | | 9/1975 | Rogers, Jr. et al. |
| 4,071,275 | A | | 1/1978 | Rogers, Jr. |
| 4,108,491 | A | | 8/1978 | Rogers, Jr. |
| 4,185,869 | A | | 1/1980 | Rogers, Jr. |
| 4,188,062 | A | | 2/1980 | Rogers, Jr. et al. |
| 4,226,469 | A | | 10/1980 | Rogers, Jr. et al. |
| 4,249,772 | A | | 2/1981 | Rogers, Jr. |

(Continued)

*Primary Examiner*—Anthony D. Barfield
(74) *Attorney, Agent, or Firm*—Myers Bigel Sibley & Sajovec

(57) ABSTRACT

A three position reclining chair having a front panel, arms, a seat cushion and a seat back, has a positioning linkage with interconnected seat support, leg support and seat back linkage groups. The seat support linkage group supports the chair seat for forward movement from the first, closed and erect position, so that initial forward movement of the seat actuates the leg support linkage for extending and rotating leg support members, to provide a second, TV position, and continued forward movement actuates the seat back positioning linkage, to rotate and incline the seat back without rearward movement of any portion thereof.

28 Claims, 9 Drawing Sheets

U.S. PATENT DOCUMENTS 4,337,977 A 7/1982 Rogers, Jr. et al.
4,350,386 A 9/1982 Rogers, Jr.
4,350,387 A 9/1982 Rogers, Jr.
4,352,523 A 10/1982 Holobaugh, Jr.
4,357,049 A 11/1982 Rogers, Jr. et al.
4,418,957 A 12/1983 Rogers, Jr.
4,570,995 A 2/1986 Rogers, Jr.
4,740,031 A 4/1988 Rogers, Jr.
4,805,960 A 2/1989 Tacker
4,915,444 A 4/1990 Rogers, Jr.
5,072,988 A 12/1991 Plunk
5,121,967 A 6/1992 Rogers
5,129,701 A 7/1992 Pine
5,156,441 A * 10/1992 Byersmith et al. ..... 297/68 X
5,354,116 A 10/1994 May et al.
5,419,611 A 5/1995 Cook
5,795,021 A 8/1998 Rogers
5,971,475 A 10/1999 Lawson et al.
5,975,627 A 11/1999 LaPointe et al.
5,992,930 A 11/1999 LaPointe et al.

* cited by examiner

METHOD AND APPARATUS FOR A THREE POSITION WALL-AVOIDING RECLINING CHAIR

TECHNICAL FIELD

The present invention relates to the field of reclining chairs and, more particularly, reclining chairs providing at least three distinct operating positions without substantial rearward displacement and while retaining essentially the same aesthetics of the chair body.

BACKGROUND

Reclining chairs and other so-called "motion furniture" have become fixtures in the home decorator's lexicon. This type of furniture is unique in the combination of comfort and convenience afforded by its selective body positioning capability, and is considered by many to be an essential element of the complete home.

In general, the recliners available today are classified as either two or three position. The first position is a conventional seating, or so-called "closed" position, which places the user's feet on the floor with the seat back in a relatively erect position, typically tilted at an angle in the range from approximately vertical to approximately twenty-five degrees (25°), although a more reclined angle could be used if desired. The second is known as the "TV" position, wherein a leg rest is extended to at least somewhat support the user's legs in an ottoman-like manner, while the seat back remains either substantially unchanged from the closed position or is tilted further. Typically, the seat back is tilted at an angle in the neighborhood of approximately thirty degrees (30°) from vertical, although other angles equal to or greater than seat back angle in the closed position could be used if desired. The third position is known as the "reclining" position, wherein the seat back is generally tilted backwards a greater amount than in the TV position, typically approximately thirty or more degrees from the vertical, or as otherwise desired. In the reclining position, the leg rest is also extended to a greater degree than in the TV position. For purposes of both comfort and aesthetics, the seat back is often covered by an upholstered "T" shaped back cushion, which fits down to the seat cushion and extends over the chair arms. The central portion of the cushion extends downwardly between the chair arms, close to or touching a seat cushion.

Typical three-position motion furniture has placement limitations in a room because the rearward tilting of the seat back results in wall contact, unless sufficient clearance is allowed when positioning the furniture. A number of so-called, "wall-avoiding" designs have been offered. Three-position recliners, including wall-avoiding recliners, tend to be less pleasing to the eye than similar, two-position or static furniture, especially from the rear. This is because of the irregular rear surface and the unsightly vertical and horizontal gaps left between the moving and stationary portions of the back and sides. Also, "T" shaped back cushions do not work very well with three-position recliners, because the relative movement between the seat back and the arms causes binding with the chair arms and displacement or distortion primarily of the "wings" forming the "T" shape of the back cushion. As a result, back cushions that do not extend over the arms are usually used on three-position wall-avoiding recliners and the frontal appearance is less finished looking than a similar two-position piece or a chair that does not recline.

There are a number of three-position operating mechanisms in the prior art, both powered and manually operated. In a common arrangement, the leg rest is raised, so as to place the chair in the "TV" position. Then, the seat back acts as a lever to raise the seat slightly as the back is pushed into the full reclining position. Shifting the full weight of the user to the seat reverses the back movement and restores the chair to the "TV" position. Significant displacement of the seat back in rearward and downward directions takes place relative to the arms as it is moved to the full reclining position. Gaps in the upholstery, unsightly deformation of the back cushion and discontinuities in the outline or surface of the chair may result, diminishing or destroying the aesthetic appeal of the chair design.

An object of the present invention is therefore to provide three position reclining motion in a wall-avoiding configuration. A second object is to improve the appearance of furniture employing this three position reclining motion by eliminating unsightly gaps and discontinuities in the chair outline or surface to retain the aesthetic appeal of the furniture piece. A third object is to provide this three position reclining motion without significant distortion of a "T" shaped back cushion. A fourth object is to provide three position reclining motion in a form, which may be either powered or manually operated.

SUMMARY OF THE INVENTION

The present invention comprises a method and apparatus for effecting a three position reclining motion in a reclining chair, seat, couch or other motion furniture. A chair incorporating the invention generally comprises a front leg rest, one or more arms, a seat and seat cushion and a seat back and back cushion. Beginning with the chair in the first, closed position, a mechanism effects forward translation of the seat with respect to the arms. Forward movement of the seat combines with extension of the leg rest to provide a leg support that approaches the height of the seat cushion, in an ottoman-like relationship, in a TV position. Movement of the seat from the closed to the TV position may alternatively be slightly upward in addition to a more substantial forward movement. By maintaining approximately the same or increasing somewhat the height of the seat relative to the chair arms during forward movement of the seat, support of the back cushion is maintained. As the chair operates from the TV position toward the reclining position, the seat mechanism effects forward and preferably upward movement of the seat and forward movement of the seat back lower edge, more or less following the seat forward, as the seat back rotates into a reclined position. As the seat moves toward its fully forward position, the mechanism raises the seat assembly with respect to the chair arms. Movement of the seat and seat back cooperate to further support the cushion against substantial vertical displacement or distortion, which is particularly beneficial when the back cushion is a "T" shaped back cushion.

In one aspect of the invention, the motion furniture piece comprises a frame or shell having back and side panels surrounding the seat and seat back, forming an outline and exterior surface of the furniture piece that does not change substantially in appearance during movement between the closed, TV and reclining positions.

In another aspect of the invention, the back panel remains stationary as the seat back moves, thus allowing operation between the closed and reclining positions with little or no clearance required behind the furniture piece.

In another aspect of the invention, the arms remain stationary during movement between the closed and reclining positions.

In still another aspect of the invention, the mechanism effectuating the reclining movement is supported by the furniture frame or shell, which in turn is supported directly on the floor or on legs attached to the sides or arms of the frame or shell.

BRIEF DESCRIPTION OF THE DRAWINGS

The accompanying drawings are incorporated into the specification to assist in explaining the present invention. The drawings illustrate preferred and alternative examples of how the invention can be made and used and are not to be construed as limiting the invention to only those examples illustrated and described. Moreover, drawings of linkage members are generally not to scale, but only illustrate the relative positions and general movement of linkage members during operation. The various advantages and features of the present invention will be apparent from a consideration of the drawings in which.

DETAILED DESCRIPTION OF THE DRAWINGS

Figure 1:
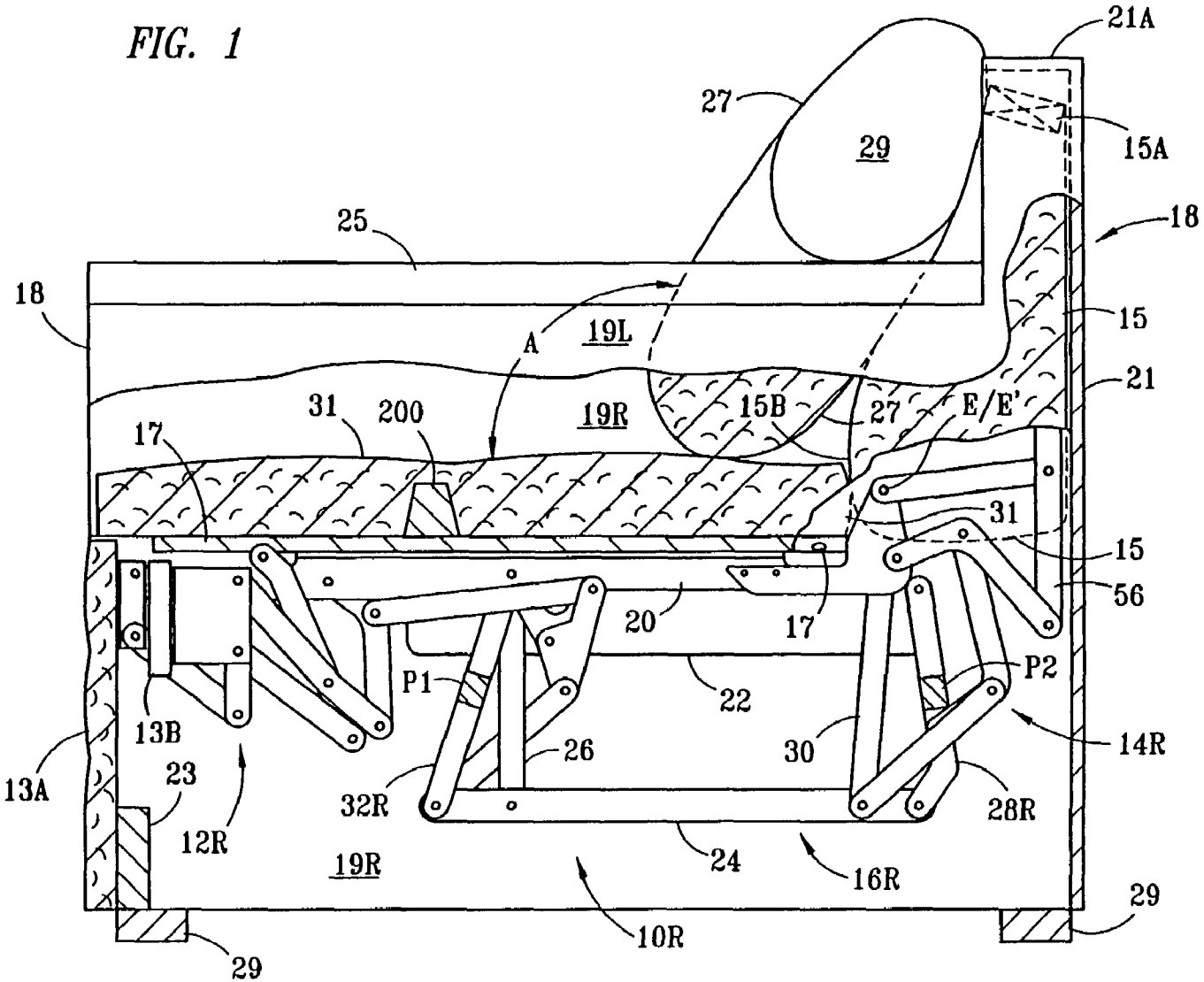
FIG. 1 is an elevation view of one side of a preferred embodiment of the operating linkages of the present invention.

The preferred embodiment of the invention is described as follows by referring to the accompanying drawings. In these drawings, reference characters are used throughout the views to indicate like or corresponding parts. The designations "L" and "R" used with the same reference numeral denote location of the structure identified on the left and right sides, respectively, of the chair illustrated, from the perspective of a person sitting in the chair. Such structures identified by reference numerals differing only in the use of "L" and "R" designations are constructed and operate as virtually mirror images, in accordance with the preferred embodiment of the invention. The embodiment shown and described herein is exemplary. Many details are well known in the reclining furniture arts, and as such are neither shown nor described.

FIG. 1 shows one side of a preferred embodiment of the operating linkage assembly 10 of the present invention. Operating linkage assembly 10 includes a leg rest linkage group 12 for extending leg rest 13; seat back linkage group 14 for positioning a seat back 15; and seat support linkage group 16 for supporting and actuating a seat 17 and actuating the leg rests 13A and 13B and seat back linkage groups 12 and 14, respectively. Portions of operating linkage assembly 10 that would be hidden from view in the various Figures are illustrated with broken lines.

The operating linkage assembly 10 of the preferred embodiment of the invention shown is a "constrained" linkage mechanism, which provides a more fluid motion than certain other mechanisms, such as those employing "stops" at predetermined positions. The assembly 10 thus allows continuous, fluid movement and adjustment of the positions of the seat 17, leg rests 13A and 13B and seat back 15, without noticeable, abrupt variations of resistance to movement or speed of movement often caused by mechanisms employing "stops" or other structures to transition between movement from the TV position to either the closed or reclining positions. However, it will be apparent that a perhaps less desirable mechanism that is not constrained might be employed to provide numerous desirable aspects of the present invention.

The operating linkage assembly 10 comprises two assembly sides 10L (not shown) and 10R, each supported by opposite longitudinal sides 19L (partially shown) and 19R of the chair. Operating linkages 10 of the present invention are in three interconnected functional groups, leg rest linkage group 12, seat back linkage group 14 and seat supporting group 16. Each of the functional groups 12, 14 and 16 comprise two halves, designated by "L" and "R," that are interconnected and operate substantially synchronously, to support and position the respective leg rests 13A and 13B, seat 17 and seat back 15 during operation of the linkage assembly 10. It will be understood by those skilled in the art, that the various linkage parts are formed from stamped steel, with offsets where needed to make a connection or avoid interference.

The operating linkage assembly 10 is supported by a chair exterior frame 18 comprising longitudinal sides 19L and 19R, an upstanding, essentially rectangular and undivided rear panel 21 and, preferably, a front cross-member 23.

Although longitudinal sides 19L and 19R each form an arm of the chair, it will be apparent that certain features of the invention may be employed with one or no arms formed by the sides 19L and 19R, such as, for example, where the chair has no arms or comprises an end- or mid-section of a sofa, wherein the section has one or no arms.

In comparison with prior art recliners, leg rest linkage group 12 has a relatively short height dimension, when retracted and the chair is in the closed position, relative to the extended length of the group. Amongst a number of advantages, the configuration of the leg rest linkage group 12 permits placement of the leg rests 13A and 13B and front cross member 23 adjacent the front of exterior frame 18. It will be apparent from the drawings that the leg rest linkage group 12 comprises three scissor linkages, which cooperate to extend the leg rests 13A and 13B forward a distance that is approximately two to three times the height of the linkage group when it is retracted. It will also be apparent that the height of the leg rest linkage group 12 when in the closed position is substantially lessened by the use of three scissor cross linkages, rather than using one or two scissor linkages that would require longer scissor members, resulting in a greater retracted height. The height of the leg rest linkage group 12 allows placement of the seat 17 at a lower height, in turn resulting in a lower seating height than otherwise. It also allows placement of cross member 23 across the front of the frame 18.

Front cross member 23 serves as a back stop or support stabilizing the leg rest 13A against unwanted movement when the leg rest 13A is fully retracted. Cross member 23 is positioned below the path of travel of the leg rest linkage group 12, to provide both rigidity to the construction of the frame 18 and avoid interference with extension of the leg rests 13A and 13B. This placement of cross member 23 is very desirable for its provision of added space for the linear actuator 90, later shown in FIG. 11.

Together, the sides 19L and 19R and rear panel 21 form the outline and exterior surface of the chair, which may be designed and constructed to provide a variety of aesthetics, designs and appearances in addition to structural support of the chair. Arms 25 are mounted to the sides 19L and R. Seat cushion 31 covers seat 17 and extends under and at least partially supports "T" shaped back cushion 27, which rests against seat back 15. Wings 29 of "T" shaped back cushion 27 extend over and are at least partially supported by arms 25. Extending across the width of the top of the rear panel 21 is a cap 21A, forming a partial enclosure for the upper end of the seat back 15, when the chair is in the closed position. The enclosure blocks a substantial portion of the seat back 15 from view. Note that portions of the seat back 15, seat 17, "T" shaped back cushion 27 and seat cushion 31 that would otherwise obstruct the view of components of the operating linkage assembly 10 in FIG. 1 have been cut away and illustrated instead with broken lines. Additionally, an angle of recline A identifies the measurement of degrees separating the outer surfaces of the back cushion 27 and seat cushion 31.

Although the term "T" shaped back cushion is used with reference to the cushion of the preferred embodiment shown, the term also encompasses other back cushion shapes in which the upper end of the cushion is wider than the lower end of the cushion, particularly above one or more sides or arms of a chair, sofa, sofa component or other seating device. Thus, a cushion shape that gradually widens, for example, toward the upper end would be encompassed by this term. It will be apparent that cushion shapes that are wider above a side or arm of a chair present the possibility of deforming or binding as the cushion is reclined. Accordingly, "T" shaped back cushions comprise numerous shapes in addition to the shape shown in the accompanying drawings, having an abrupt and substantially rectilinear angle extending the wings transversely and outwardly from the central portion of the seat cushion 27. Correspondingly, the term "wings" of a "T" shaped back cushion encompasses a variety of shapes and need not extend abruptly and at substantially right angles from the cushion in the manner of wings 29 of cushion 27. Instead, the term "wings" encompasses any portion of a back cushion that forms a wider portion than an adjacent portion of the cushion.

The central, basic groups are the right and left hand seat supporting groups 16L (not shown) and 16R. Attachment plates 22 are rigidly mounted to the inside surfaces of an exterior frame 18, to support the linkage assembly 10. Seat supporting linkage groups include seat supporting members 20, connected to longitudinal base members 24 by first forward and rearward links 32 and 30, respectively, so as to form four-bar linkages. Longitudinal base members 24 are also included as part of a second set of four-bar linkages, through their connection to attachment plates 22 by second forward and rearward links 26 and 28 respectively. The opposite operating linkages 10L (not shown) are connected to the shown linkages 10R by tubular cross-members P1 and P2 at the indicated locations. These cross-members P1 and P2 hold the two sides in alignment and coordinate the pivotal movement of the first and second forward and rearward links 32L/32R 28L/28R respectively, so that linkages 10R and 10L move in unison. Should a power operated recliner be desired, a linear motor connected between cross members P1 and P2 will serve to actuate linkages 10 to any of the three positions.

Figure 1A:
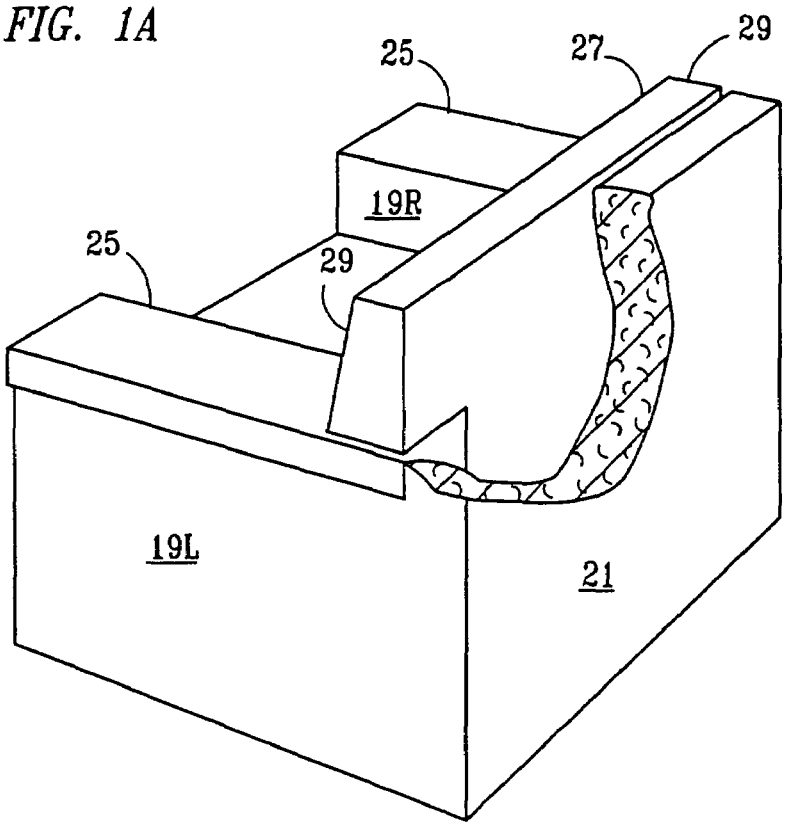
FIG. 1A is a schematic perspective view of the reclining chair of the present invention.

FIG. 1A illustrates the relative positions of primary components of a three position reclining chair and certain features of the invention. Here it is seen clearly that "T" shaped wings 29 of "T" shaped back cushion 27 extend over arms 25, creating the potential of cushion distortion as the cushion 27 rotates between the closed position and the reclining position. This potential is neutralized or at least substantially reduced by certain aspects of the chair construction and operation. More specifically, the present invention is capable of operation between closed and reclining positions of the chair, without deforming the wings 29 at all or preferably no more than about 1" relative to the remaining central portion of the back cushion 27.

Figure 1B:
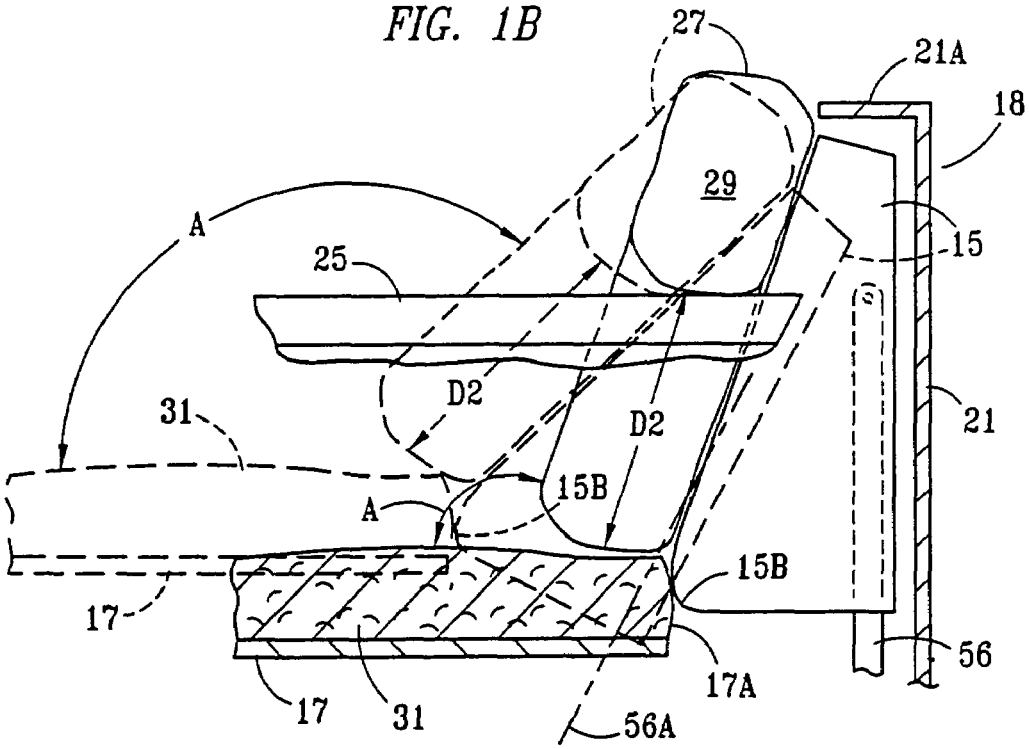
FIG. 1B is a partial section side elevation of a preferred embodiment of the invention, illustrating the range of motion between the closed and reclining positions.

Referring to FIG. 1B, shown is the movement of the preferred embodiment of FIG. 1 between the closed position (shown in solid lines) and the reclined position (shown in broken lines).

Figure 2:
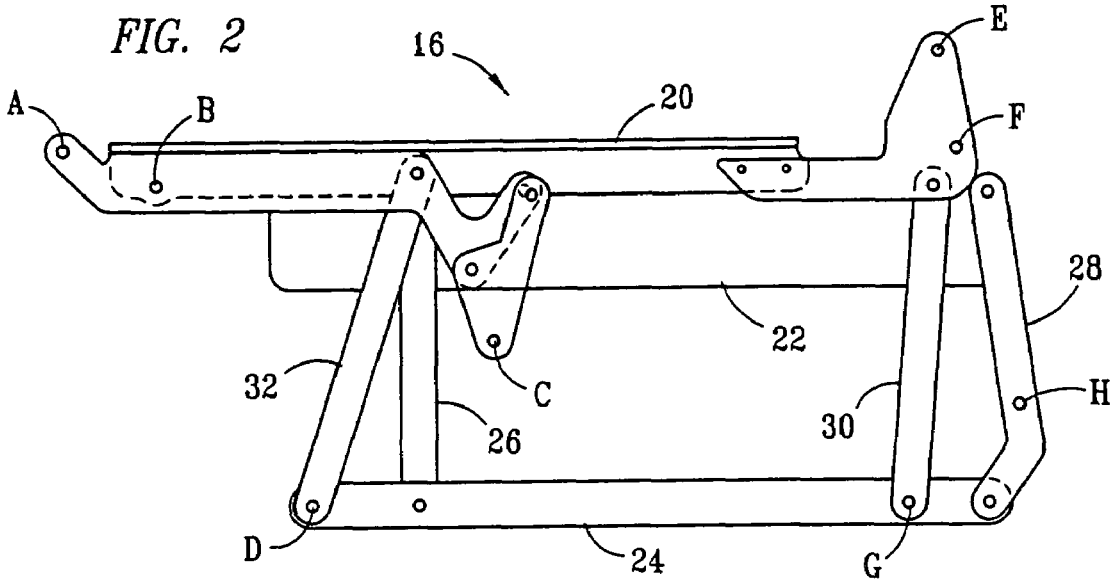
FIG. 2 is a view similar to FIG. 1, showing only the seat support linkage group in isolation.

FIG. 2 shows the seat support linkage group 16 in isolation to better illustrate the manner in which the seat support members 20 move in relation to longitudinal base members 24 and attachment plates 22. It will be noted that, on initial forward movement (to the reader's left) relative to the arms 25, seat support 20 will rise slightly and to a greater extent at the front. This provides a slight "downhill" effect when returning the chair to the closed position. Beyond this initial forward movement, it will be seen that, as the vertical distance between seat support members 20 and longitudinal base members 24 is reduced by the angularity of first links 32 and 30, the vertical distance between attachment plates 22 and longitudinal base members 24 is also reduced by the angularity of second links 26 and 28. It will subsequently be shown the manner in which seat supporting members 20 are elevated with respect to chair arms 25 when moving toward its full forward position. Also shown here are points A, B, C & D connecting to leg rest linkage group 12 (shown by FIGS. 3 and 4 in more detail) and points E, F, G & H connecting to seat back linkage group 14 (shown by FIGS. 5, 6, and 7 in more detail).

Figure 3:
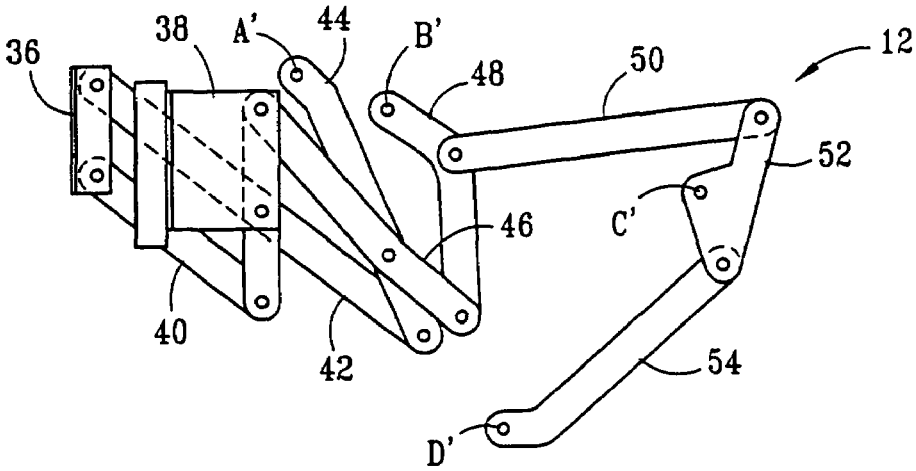
FIG. 3 is a view similar to FIG. 1, showing only the leg rest linkage group in isolation.
Figure 4:
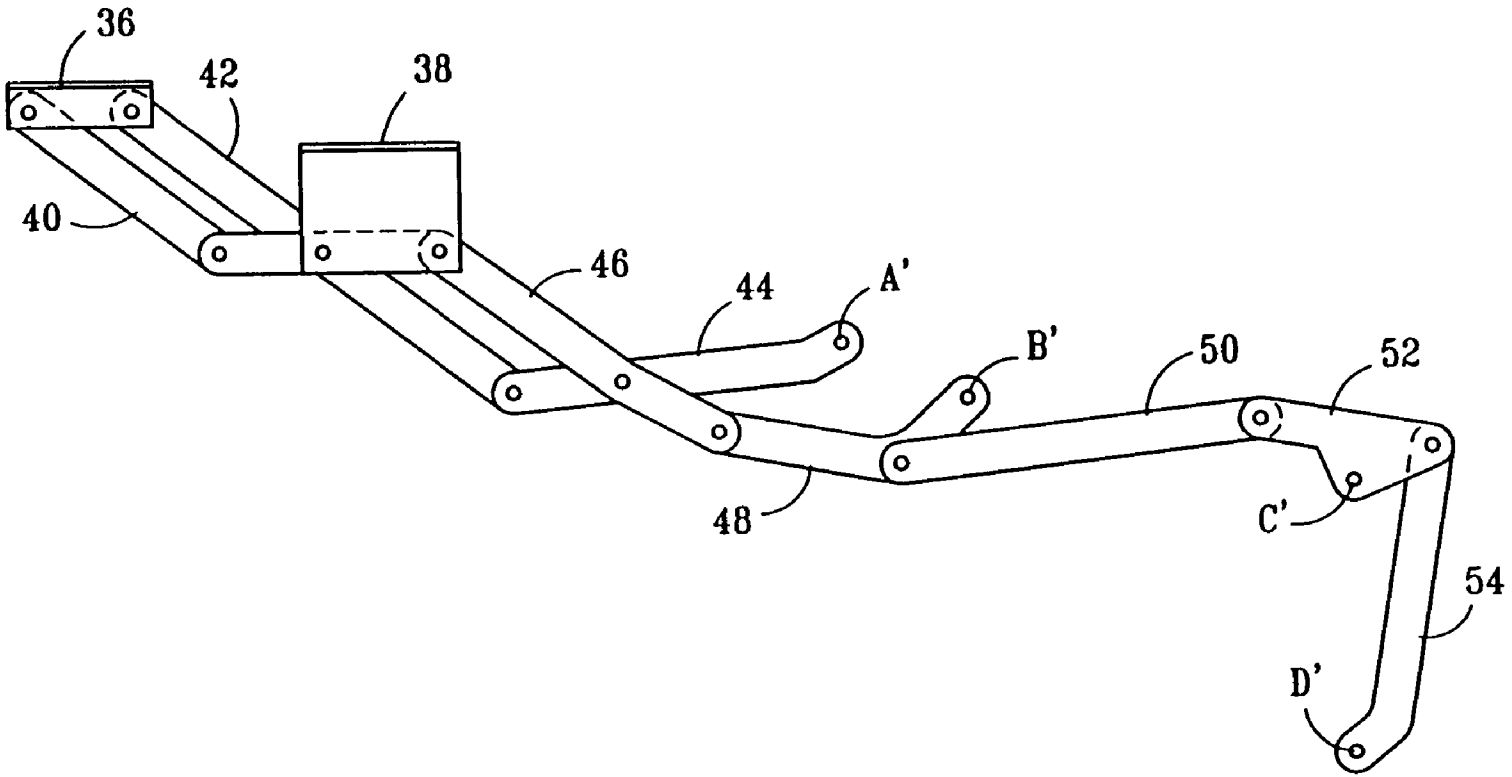
FIG. 4 is a view of the linkage of FIG. 3 as it appears when the leg rest is extended to the "TV" position.

FIGS. 1, 3 and 4 show leg rest linkage group 12, with connecting points A', B', C' & D' (shown in FIGS. 3 and 4) for connection to seat support linkage groups 16. The transverse leg rests 13A and 13B are attached to leg rest brackets 36 and 38, respectively. These brackets act as parts of scissor linkage members 40, 42 and 44, 46. When actuated from the retracted position to the extended position, the scissor linkages rotate and lift the leg rests 13A and 13B into substantially the same horizontal plane to support the legs of a person seated in the chair. In the TV position and reclining positions, the leg rests 13A and 13B are positioned as desired within a range of positions, beginning at a position somewhat extended from the fully retracted position to a position at or even above the upper surface of the seat cushion 31. The leg rest 13B retracts in the closed position to a location behind and hidden from view by the leg rest 13A. The height dimensions of the leg rests 13A and 13B are preferably such that the rests are spaced from but adjacent each other when fully extended to form a substantially continuous support surface. In the preferred embodiment shown, partial extension to a height near that of the seat cushion 31 is reached in the TV position and full extension to the height of seat cushion 31 is reached in the reclining position. The leg rest 13A forms a front panel of the chair in the closed position, extending between and covering the front of the longitudinal sides 19L and 19R and extending between the seat cushion 31 and a position just above the floor. The leg rest 13A hides the front cross member 23 and the leg rest 13B from view, and presents a single panel across the front of the chair, below the cushion 31.

As is best illustrated in FIG. 1, in the closed position, the front surfaces of the longitudinal sides 19L and 19R, the leg rest 13A and the cushion 31 are aligned by the linkage assembly 10, so as to present a substantially flush front surface, enhancing the appearance of the chair. The unitary, rigid, boxed wood frame construction of the chair frame 18 and the linkage assembly 10 configuration and operation allow the chair to move between the closed and reclining positions without relative displacement of the longitudinal sides 19L and 19R, including any chair arms, and the rear panel 21. This allows the chair to be supported by aesthetically pleasing wooden (or other finish) legs 29, secured at or near the corners of the bottom of the frame 18 and raising the frame 18 above floor level, without direct connection to the linkage assembly 10. This avoids the appearance of unsightly metal legs of conventional reclining mechanisms. The exterior surface of the frame is preferably covered with leather or other upholstery, presenting a substantially continuous surface, particularly at the corners formed by the intersection of longitudinally sides 19L and 19R with the rear panel 21. During operation of the chair, the frame 18 retains its pleasing aesthetic appearance, without forming or enlarging visible gaps, clearance seams, slack upholstery and the like associated with conventional recliners.

Scissor linkage members 44 are connected to seat support linkage groups 16 at connecting points A/A' with pivot pins, and working members 48 are connected to seat support linkage groups 16 at connecting points B/B' in a similar manner. Bell cranks 52 are connected to seat support linkage groups 16 at connecting points C/C' and links 54 are connected to seat support linkage groups 16 at connecting points D/D'. Seat support members 20 move forward with respect to longitudinal base members 24, push on links 54 at connecting point D/D' (shown in FIGS. 2, 3 and 4) and cause bell cranks 52 to rotate about connecting points C/C'. This motion drives connecting links 50 forward to actuate leg rest linkage groups 12 in the manner shown in FIG. 4. It is to be noted that, when fully extended, bell cranks 52, connecting links 50 tie longitudinal base members 24 to seat support members 20 so as to limit their relative movement.

Figure 7:
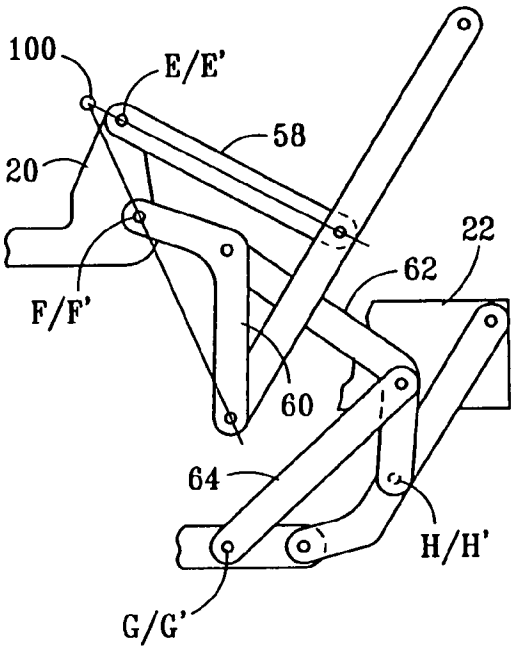
FIG. 7 is a view of the linkage of FIG. 5, as it appears when the seat back is angled to the reclining position.
Figure 6:
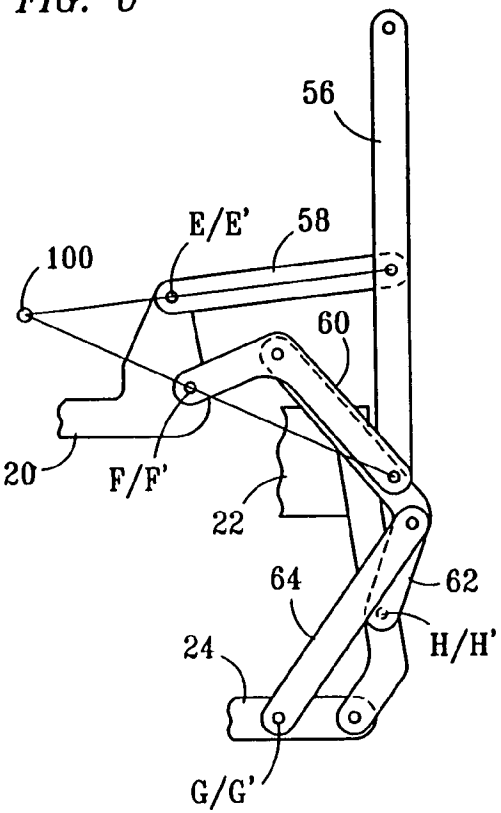
FIG. 6 is a view of the linkage of FIG. 5, as it appears when the chair is in the intermediate, or TV position.
Figure 5:
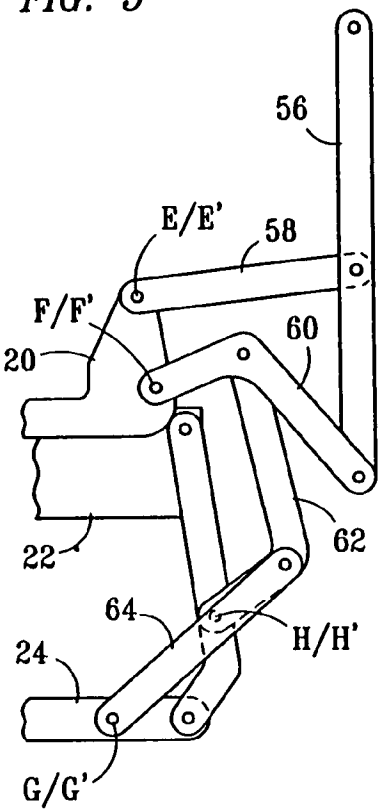
FIG. 5 is a view similar to FIG. 1, showing only the seat back linkage group in isolation as it appears when the chair is in the closed position.

FIGS. 5, 6, and 7 show seat back linkage groups 14 in isolation and the connecting points E', F', G' & H' for connection to seat support linkage groups 16. It should be noted that the angle of back support member 56, shown to be vertical for the "closed" position of FIG. 5, may be shaped or configured to incline as much as approximately twenty-five degrees (25°) in the closed position, or otherwise, according to preference. It will be apparent that the angles of inclination of the back support members 56, seat back 15 and both the front and rear surfaces of back cushion 27 are selected in combination to provide the resultant angle A between the surfaces of the back cushion 27 and the seat cushion 31, as well as the angle of inclination of the back cushion 27 front surface from the vertical. The seat back is attached to back support members 56 and these members in turn, are pivotally connected to seat support members 20 by seat back upper and lower links 58 and 60 at connecting points E/E' and F/F', respectively. The position of links 60 is controlled by links 62, which are connected to seat support linkage groups 16 at connecting points H/H' with pivot pins. The position of links 62 is controlled by links 64, which are connected to longitudinal base members 24 of seat support linkage groups 16 at connecting points G/G' with pivot pins.

Figure 9:
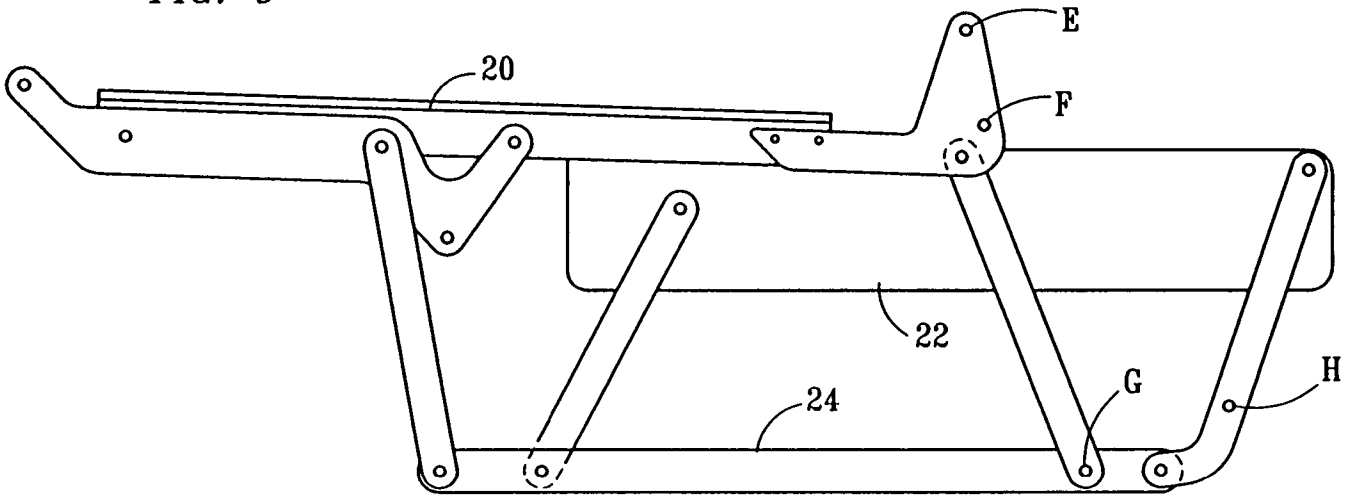
FIG. 9 is a view similar to FIG. 1, showing the seat support linkage group in isolation, with the component parts positioned as when connected to the seat back linkage group as shown in FIG. 7.

FIG. 5 shows seat back linkage group 14 when the recliner is in the closed position of FIG. 1. FIG. 6 shows the movement of seat back linkage 14 as the chair is changed from the closed position to the "TV", or intermediate position. Here, seat support members 20 are moved forward with respect to longitudinal base members 24, and links 62 are rotated in a counter-clockwise direction about connecting points H/H'. As seat back support members 56 and links 58 and 60 move forward with seat support members 20 there is virtually no relative movement of seat back support members 56 with respect to seat support members 20. When bell cranks 52 and links 50 are nearly fully extended, as shown in FIG. 4, the chair is in the "TV" position. FIG. 9 shows that further movement of seat support members 20 causes longitudinal base members 24 to move relative to attachment plates 22.

As shown in FIG. 7, connecting links 62 cause further forward and upward movement of the seat support members 20, as links 62 rotate in a counter-clockwise direction about points H/H'. This, in turn, causes seat back lower links 60 to rotate in a clockwise direction about connecting points F/F'. In turn, this causes seat support members 20 to rotate so that the lower edge of the seat back moves forward and upwardly as the seat back is rotated about virtual transverse axis 100 to an angle of thirty degrees or more with respect to vertical, or as otherwise desired. The intersection of extended lines through the pivot points of links 58 and 60 reveals the instant center, or virtual transverse axis 100, about which all of back support member 56 is rotating at any stage of its movement.

Referring particularly to FIGS. 1, 1B, 5, 5A, 6, 6A, 7 and 7A, the axis 100 is positioned above the seat 17 and seat support members 20, causing the rotation component of the back support members 56 and seat back 15 to be about a point at or near the location of the hips of an average person seated in the chair. This is also approximately the point about which that person will bend at the waist as the chair moves toward the recline position. Positioning the axis 100 in this manner coordinates rotational movement of the back cushion 27 to avoid upward movement of back cushion 27 relative to the back of a person sitting in the chair, which might otherwise in some cases cause the shirt or blouse to be pulled upwardly from the waste.

As the seat back 15 is moved toward the reclining position, the virtual transverse axis 100 rises, gradually diminishing the rate at which the upper end of the members 56 and seat back 15 fall back from or reclines relative to the seat 17 as the forward and upward movement of the seat 17 continues. At the same time, rising of the transverse axis 100 causes the lower end of members 56 and seat back to gradually move forwardly at a faster rate than the seat 17 and to gradually decrease its downward movement relative to the seat 17. Clearance from the rear panel of the frame 18 for the reclining movement of the seat back 15 is provided by the forward movement of both the seat 17 and the seat back 15 during movement from the closed position to the TV position. Additional clearance is provided for the reclining seat back 15 by the continued forward movement of both the seat 17 and seat back 15 as the chair moves from the TV position to the reclining position. It will be appreciated that the substantially synchronous forward movement of the seat 17 and seat back 15 as the chair moves from the closed position to the reclining position maintains the back cushion 27 in contact with and supported by the seat cushion 31 against downward movement and substantial deformation. More specifically, this positions the central portion of the back cushion 27 in contact with the upwardly moving seat cushion 31 during movement from the TV position to the reclining position, supporting the seat cushion 27 from substantial displacement downwardly relative to the chair arms 25 and avoiding substantial distortion of the back cushion wings 29.

FIG. 7 shows that virtual transverse axis 100 is higher with respect to seat support members 20 than it is in FIG. 6. This elevation of the axis about which the seat back rotates as the seat moves forward to the reclining position is helpful in eliminating rearward movement of the seat back and achieving the "wall-avoiding" attribute of the present invention. Elevation of the axis 100 also aids movement into the reclining position by causing the upper end of the seat back 15 to move downwardly relative to the seat 17 more than does the remainder of the seat back 15, including the lower end. As the seat back moves from the TV position to the reclining position, the seat back 15 also rises relative to the frame 18 at a lesser rate than the upwardly moving seat 17, assisting in the support of the back cushion 27. In addition, the virtual transverse axis 100 migrates toward the cushion wings 29 during this movement, as a further aid in avoiding substantial deformation of the wings 29.

FIGS. 1, 1A, 1B, 5A, 6A and 7A illustrate the relative positions of seat 17, seat back 15, seat cushion 31, "T" shaped back cushion 27 with wings 29 and rigid frame 18 with arms 25, as operating linkage assembly 10 assumes the closed, TV and reclining positions. The construction and operation of the chair shown in FIGS. 1 and 1B differs from the configuration shown in FIGS. 5A, 6A and 7A primarily in that the former utilizes a preferable seat back 15 having a more reclined surface and a more forwardly extended surface supporting the back cushion 27, which will be discussed in more detail within.

Figure 7A:
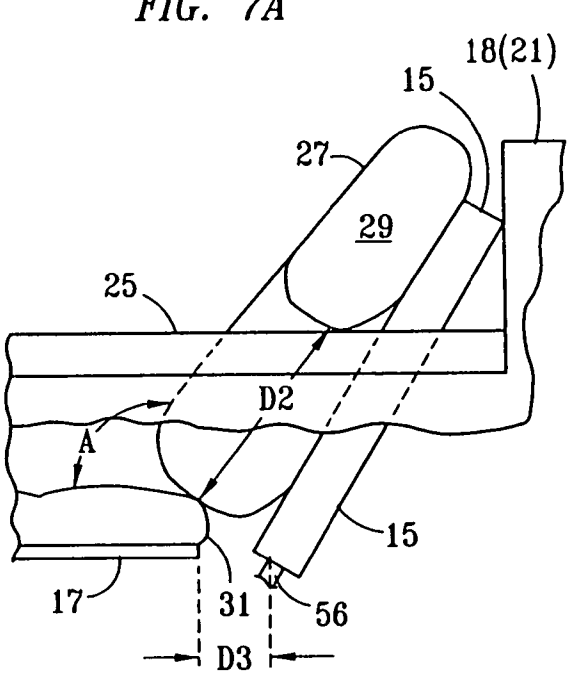
FIG. 7A is a view showing the relative "T" shaped and seat cushion positions of the present invention as shown in FIG. 7.

As is seen best in FIGS. 1, 1B, 5A, 6A and 7A, little or no interference is maintained between the "T" shaped back cushion wings 29 and arms 25 as the chair is moved between the three positions. It will be appreciated that the wings 29 may be placed in contact with and partially supported by the arms 25 in the closed and TV positions shown in FIGS. 1, 1B (closed position shown), 5A and 6A, without experiencing substantial deformation. In that case, the wings will slide along the arms 25, but will not experience sufficient frictional resistance from the arms 25 so as to bind or deform. Thus, "T" shaped back cushion 27 is relatively free to move forward with respect to arms 25, without substantial drag or distortion. FIGS. 1B and 7A illustrate the effect of raising seat 17 and seat cushion 31 with respect to arms 25 as seat 17 and seat back 15 move further forward, and seat back 15 tilts back to the reclining position. Raising seat 17 during this further movement elevates "T" shaped back cushion 27 so as to avoid binding on arms 25 and substantial deformation of "T" shaped back cushion wings 29. It will be appreciated that the rearward portions of the wings 29 may be deformed somewhat as the back cushion is rotated towards the TV and reclined positions, without causing substantial deformation of each wing 29. It is preferable that the seat 17 be raised at least approximately 1 inch to avoid deformation of the cushion wings 29.

Figure 6A:
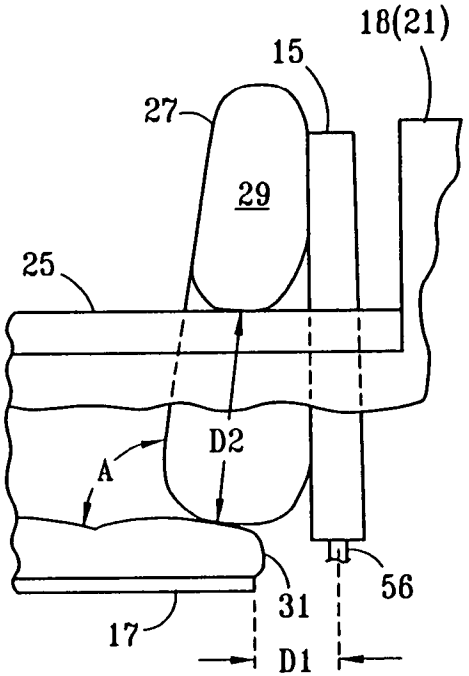
FIG. 6A is a view showing the relative "T" shaped and seat cushion positions of the present invention as shown in FIG. 6.
Figure 5A:
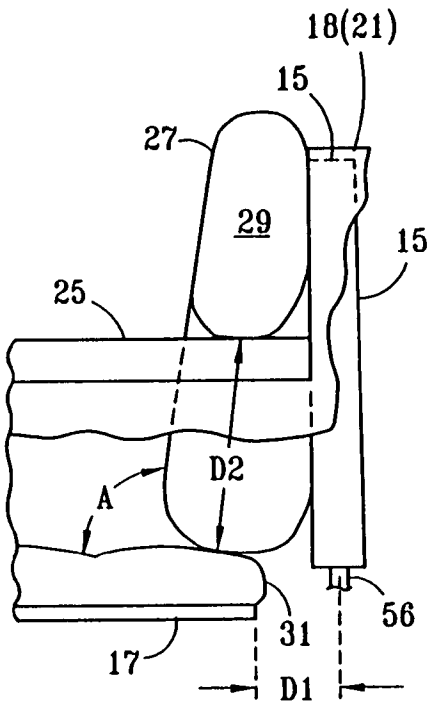
FIG. 5A is a view showing the relative "T" shaped and seat cushion positions of the present invention as shown in FIG. 5.

Referring primarily to FIGS. 1B, 5A and 6A, the relative movement of the seat back 15 and seat 17 as the chair moves between the closed and TV positions is shown. Although FIG. 1B shows the preferred embodiment in the closed position (solid lines) and reclining position (broken lines) for purposes of clarity, it will be apparent that the chair shown moves into and through the TV position in substantially the same manner as is described with respect to FIGS. 5A and 6A. In the closed position, the seat 17 is preferably pitched upwardly in the front approximately 2 degrees relative to the underlying floor and angle A between the outer surfaces of seat cushion 31 and back cushion 27 is approximately 111 degrees. The surface of cushion 27 is pitched approximately 23 degrees rearward of vertical.

In movement to the TV position, the substantially horizontal distance D1 separating the seat back support member 56 the seat 17 is maintained relatively constant by the coupling of the seat back linkage group 14 and the seat support linkage group 16. Thus, as the seat 17 moves in a forward direction as the chair is moved into the TV position, the lower end of seat back 15 is drawn forward approximately the same distance as is the seat 17, away from the rear panel 21 of the exterior frame 18. Preferably, the pitch of the seat 17 is increased gradually to approximately 5 degrees and the angle of recline A between the back cushion 27 and seat cushion 31 outward surfaces is gradually increased to approximately 114 degrees or about 23 degrees rearward of vertical, or as otherwise desired. However, while the relative positions of seat 17 and seat back 15 may be held constant or moved in another manner during movement to the TV position, forward movement of the seat should nevertheless also displace the upper end of the seat back 15 forward a sufficient distance to allow further reclining movement of the seat back 15 into the reclining position.

In the preferred embodiment, initial movement of the seat 17 from the closed position causes a gradual, but slight, initial tilt of the seat toward the rear of the chair. While the seat cushion 31 will be tilted upwardly in the front during this movement, linkage members 20 and 58 of the operating linkage group 10 will recline the seat back 15 and seat cushion 27 approximately the same amount during movement to the TV position. This coupling also maintains substantially constant the distance D2 between the wings 29 and the area of the seat cushion 31 contacting and at least partially supporting the middle section of the back cushion 27, thereby maintaining substantially constant support for the back cushion 27 against downward movement, binding against the arms 25 and deformation.

Referring primarily to FIGS. 1B, 6A and 7A, the relative movement of the seat back 15 and seat 17 as the chair moves between the TV and reclining positions is illustrated. In this movement also, the distance D2 is maintained substantially constant to maintain support for the back cushion 27 against downward movement, binding against the arms 25 and deformation. In this movement, the rearward pitch of the seat 17 preferably increases to about 6 degrees relative to the floor and angle A increases to a reclining angle of preferably about 117 degrees. Distance D2 is held substantially constant as angle A increases, by forwardly moving and raising the height of the seat 17 and seat cushion 31 relative to the chair frame 18 sufficiently to maintain support of the back cushion 27 by the seat cushion 31.

Continued forward and upward movement of the seat 17 and cushion 31 provides space for the forward movement of the lower end of seat back support member 56 relative to the frame 18. It will be appreciated that the seat back support member 56 also moves forward relative to the seat 17. Forward movement of the lower end of the support member 56 relative to the seat 17 results in a decreasing horizontal distance D3 between the lower end of the member 56 and the seat 17, allowing a greater reclining angle A to be achieved with less clearance between seat back 15 and the frame 18 than would otherwise be required. It will be apparent the back cushion 27 essentially pivots about the area of contact with the seat cushion 31 as the chair moves between the TV and reclining position. Correspondingly, the area of contact between the seat back 27 and the seat 31 essentially pivots about the area of contact between the wings 29 and the arms 25.

Referring to FIGS. 1 and 1B, there is shown a configuration of the seat back 15 that maintains a close spacing with seat 17 and seat cushion 31. The seat back 15 of FIGS. 1 and 1B reduces or avoids sliding of the back cushion 27 that might otherwise occur along the surface of the seat back 15 shown in FIGS. 5A, 6A and 7A. The seat back has an upper cross member 15A extending transversely for supporting the upper end of the back cushion 27. The front surface of the seat back 15 extends downwardly and forwardly at an angle of approximately 23 degrees forward of the vertical. The front, lower corner of the seat back 15 is curved adjacent the seat 17 and cushion 31 in a radius providing a relatively constant clearance from the seat 17 and cushion 31 during movement between the closed and reclining positions.

As is shown in FIGS. 1B, 5, 6 and 7, the position of the front lower corner of the seat back 15 forms a support surface 15B that is forwardly extended from the back support member 56 for supporting and positioning back cushion 27. As the seat back 15 moves toward the reclining position, the transverse axis of rotation 100 moves upwardly toward a position adjacent the pivot point E/E', near the center of radius of the front lower corner of the seat back 15. This causes an initial downward movement of the support surface 15B, but to a lesser extent than the downward movement of the back support member 56, due to the position of the surface 15B closer to the axis 100 than that of member 56. As the axis 100 moves upwardly, it approaches pivot connections E/E', in turn substantially maintaining the position of the support surface 15B relative to the seat 17 and cushion 31, as well as the intervening clearance. Consequently, the support surface 15B more or less follows the path of the seat 17 and the cushion 31 as chair moves between the TV and the reclining positions.

Although the preferred embodiment is shown in FIGS. 1, 5A, 6A and 7A with the seat cushion 31 supporting the back cushion 27 as the chair moves between the TV and recline positions, the invention encompasses alternative embodiments. For example, in one alternative embodiment, the back cushion 27 would be supported by and would be in direct contact with the seat 17 during this movement. In another embodiment, the back cushion 27 would be supported by and would be in direct contact with both the seat 17 and seat cushion. Alternatively, other support structure could be utilized in coordination with movement of the seat to effect substantially the same operation of at least partially supporting and avoiding substantial deformation the back cushion 27.

It will be appreciated that at the relative positions of the three primary support components of the chair, leg rests 13A and 13B, seat 17 and seat back 15, and their respective linkage assemblies 12, 16 and 14, change in operation from the closed position to the TV position. During movement of the chair from the closed position to the TV position FIGS. 5A and 6A, the front of the seat 17 moves forward and raises slightly, while the leg rests 13A and 13B raise and extend. This is sometimes referred to by those skilled in the art as a "three-way" mechanism. In the preferred embodiment, as previously discussed, the three-way mechanism is used that is also a "constrained" mechanism.

Figure 8:
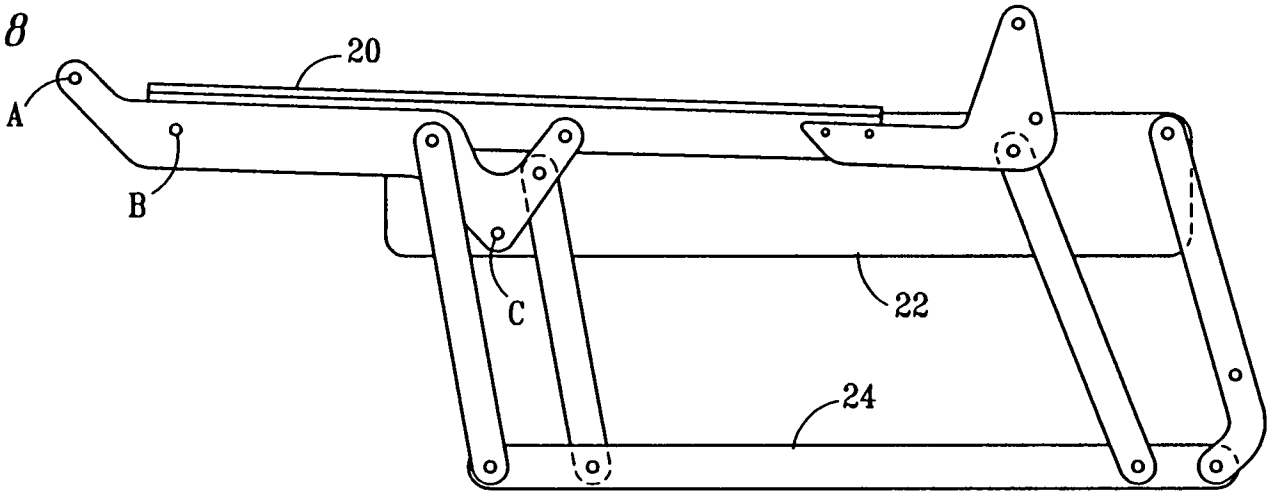
FIG. 8 is a view similar to FIG. 1, showing the seat support linkage group in isolation, with the component parts positioned as when connected to the extended leg rest linkage group as shown in FIG. 3.

FIG. 8 shows the seat support linkage group in isolation, with the component parts positioned as when points A, B, C and D are connected to mating points A', B', C' and D' of the extended leg rest linkage groups 12 as shown in FIG. 3. It should be noted that seat support members 20 have moved forward relative to attachment plates 22 substantially more than relative to longitudinal base members 24, in order to actuate the leg rest linkage group 12. The "constrained" operating linkage group 10 performs an operating sequence that actuates leg rest linkage group 12 and seat support linkage group 16 first in moving from the closed position, without regard to variations in the force applied for movement. Subsequently, continued displacement of the seat support linkage group 16 actuates seat back linkage group 14, as shown in FIG. 7, beginning with movement of base member 24 with respect to attachment plates 22 (as shown in FIG. 9).

FIG. 9 shows the seat support linkage group in isolation, with the component parts positioned as when points E, F, G and H are connected to mating points E', F', G' and H' of the seat back linkage group 14, as shown in FIG. 7. It should be noted that, in comparison to FIG. 8, seat support members 20 and longitudinal base members 24 have moved forward significantly with respect to attachment plate 22 in order to actuate seat back linkage group 14. This movement is effected last by the constrained operating linkage group 10 as seat support members 20 are moved forward in the chair frame without a need for any mechanical motion stops. It is notable that the position of seat support members 20 is one inch or more higher in relation to attachment plate 22 in FIG. 9 than is in FIG. 8. This height increase lifts the "T" shaped back cushion 27 to relieve interference as it moves forward with respect to chair arms 25. (Ref. FIGS. 1 and 1A.)

Figure 10:
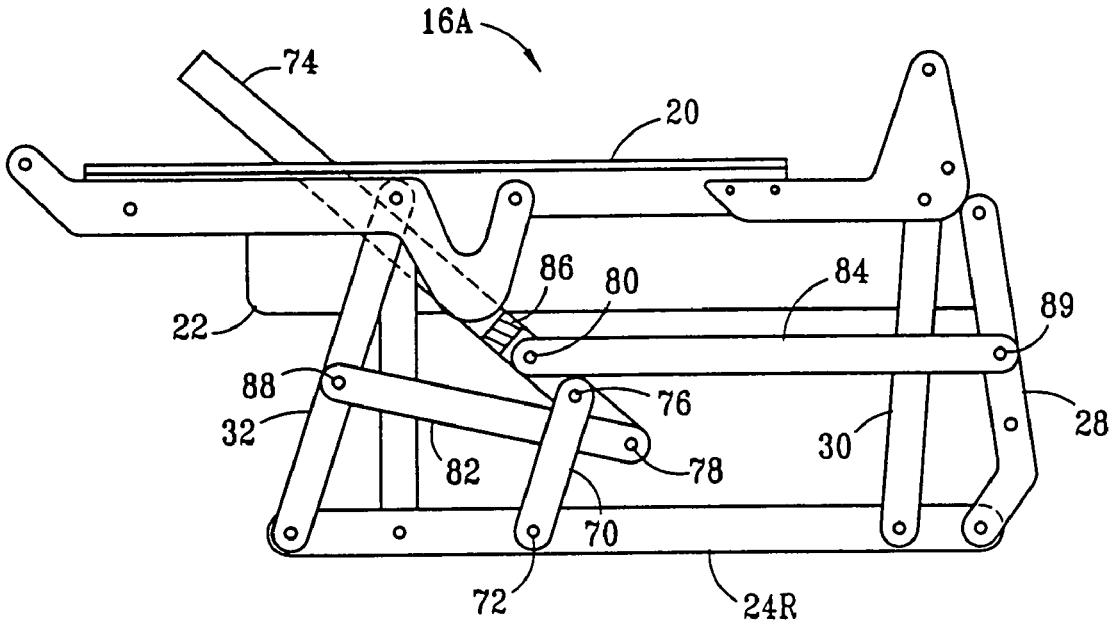
FIG. 10 is a view of the seat support linkage of FIG. 2 with the addition of a manual, lever operated seat positioning apparatus.

FIG. 10 shows seat support linkage group 16A, the same as linkage group 16 of FIG. 2 in every respect, but with additional apparatus for manual seat positioning.

Swinging link 70 is connected to longitudinal base member 24R, where it is free to rotate about pivot connection 72. Handle 74 is pivotally connected to swinging link 70 at pin 76 and extends upwardly, between attachment plate 22 and seat support member 20, where it will be situated between the seat cushion 31 and the chair side 19R for user access. Connecting pins 78 and 80, located in handle 74, respectively located at points below and above swinging link connection 76, provide for pivotal connection of compression links 82 and 84. Forwardly extending compression link 82 connects to forward first four-bar linkage member 32 at pivot point 88, while rearwardly extending compression link 84 connects to rearward second four-bar linkage member 28 at pivot point 89: Cross-member 86 rigidly connects swinging link 74 to a mirror companion linkage at the left side, identical in every respect except that the handle member 74L does not extend upwardly. Thus, both right and left linkage groups are actuated in unison. It can be seen that pulling handle 74 in a clockwise direction pushes on compression links 82 and 84 to urge seat support 20 from the first position as shown here and in FIG. 5, to the second position shown in FIG. 6, and thence to the third position of FIG. 7. Swinging link 70 allows the force determined sequential movement inherent to actuation of linkage 16.

Figure 11:
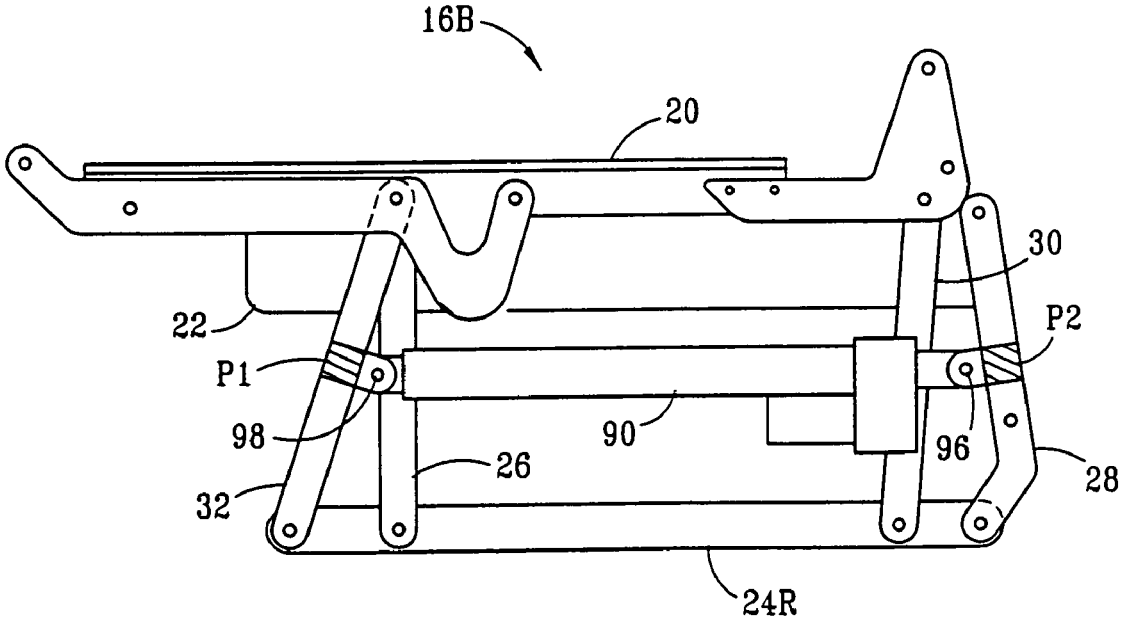
FIG. 11 is a view of the seat support linkage of FIG. 2 with the addition of a power operated seat positioning apparatus.

FIG. 11 shows seat support linkage group 16B, again the same as linkage group 16 of FIG. 2 in every respect, but with additional apparatus for powered seat positioning. Note that cross-members P1 and P2 of FIG. 1 are shown in cross-section and are rigidly connected across the right and left hand linkage groups to assure their movement in unison. Linear actuator 90 is located midway between the right and left sides, where it connects to cross-member P1 at pivotal connection 98 and cross-member P2 at pivotal connection 96. It can be seen that extension of linear actuator from the shown, retracted length to an intermediate length will urge seat support members 20 from the first position as shown here and in FIG. 5, to the second position shown in FIG. 6. Then, extension of linear actuator 90 to its full length urges seat support members 20 to the third position of FIG. 7. Here again, sequential actuation of the linkage groups is mandated by the "constrained" operating linkage group 10.

Shown in FIG. 1 is a switch assembly 200 rigidly mounted on the seat 17, between the cushion 31 and the side 19L of the chair, for controlling powered actuation of the chair toward the closed and reclining positions. The switch assembly 200 is located at a position conveniently reached by a person sitting in the chair, preferably where the arm of an average size person would rest along the side 19L of the chair. The switch assembly moves with the user and the seat 17 during operation of the chair, within convenient reach. Placed between the cushion 31 and the chair side 19L, and extending upwardly about two thirds of the thickness of the cushion, the switch assembly 200 is hidden from view so as to avoid spoiling the appearance of the chair.

Figure 1C:
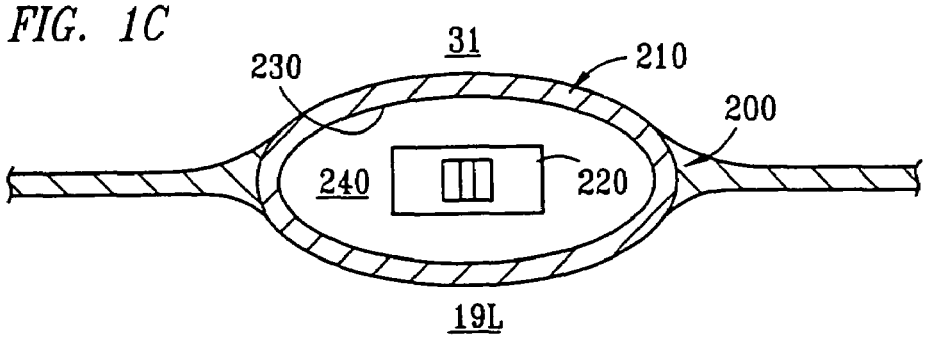
FIG. 1C is a top view of a three-position momentary switch assembly used to control powered movement of the chair.

FIG. 1C is a top view of the switch assembly 200 shown in FIG. 1. The assembly 200 includes a housing 210, which extends outwardly as it extends downwardly to the seat 17, forming a wider base than the top of the assembly 200. To facilitate movement between the upholstered chair side 19L and cushion 31, the housing 210 is oblong in shape, preferably about twice as long or more than it is wide and has blunt ends suitable for displacing the upholstered surface of chair side 19L as the seat 17 moves the assembly during operation.

The assembly 200 has an upwardly facing faceplate 240 to which is mounted an upwardly facing three position, momentary electrical micro-switch 220. The faceplate 240 and micro-switch 220 are recessed below an upwardly extending lip 230 formed by the housing 210, to protect against unintended actuation of the micro-switch 220. The microswitch 220 is biased toward the central, neutral position shown in FIG. 1C, in which the power actuator of the chair is off. Throwing the micro-switch 220 forward actuates the chair toward the closed position, while throwing the micro-switch 220 in the rearward position actuates the chair toward the reclining position. It will be appreciated that the assembly 200 is electrically connected to an actuator by electrical cables, wireless link or other means not shown.

Figure 12:
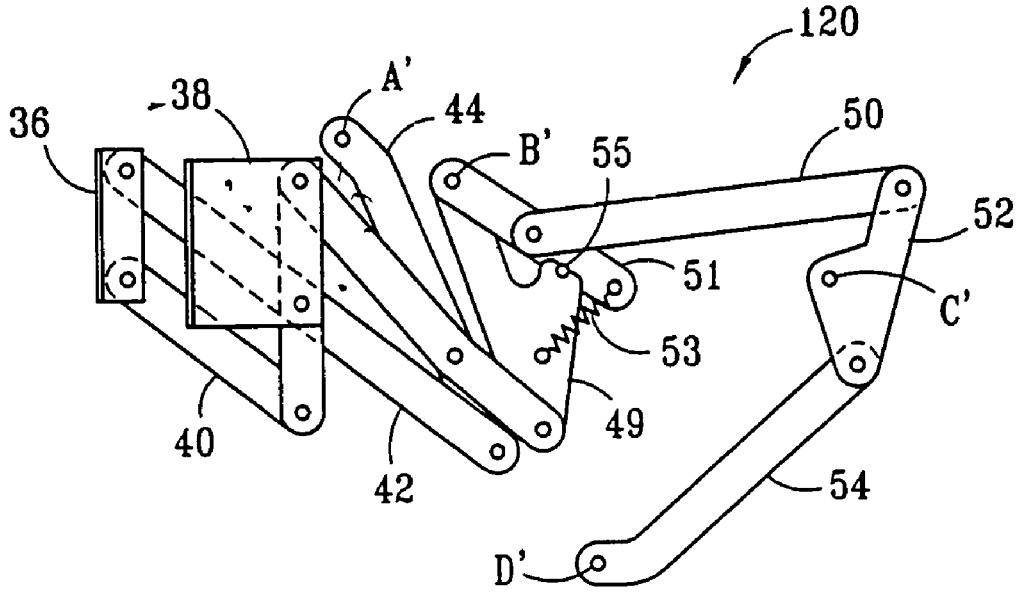
FIG. 12 is a view similar to FIG. 3, with the substitution of a spring-loaded safety device.

FIG. 12 shows leg rest linkage group 120, identical in every respect to leg rest linkage group 12, excepting for the replacement of working member 48 by a safety device comprising members 49 and 51 held in a preloaded condition by spring 53. Pin 55 bears against member 51 under the preload of spring 53 so that the connecting geometry of the safety device is unchanged from that of working member 48 of FIG. 3. However, should leg rest linkage group 120 retract against the unexpected intrusion of a child's hand, a pet or the like, the closing force exerted against the intruder is limited to a safe level by the extension of spring 53.

The embodiments shown and described above are exemplary. Even though many characteristics and advantages of the present invention have been described in the drawings and accompanying text, the description is illustrative only. Changes may be made in the detail, especially in matters of shape, size, and arrangement of the parts within the scope and principles of the invention. The restrictive description and drawings of the specific examples above do not point out what an infringement of this patent would be, but are to provide at least one explanation of how to use and make the invention. The limits of the invention and the bounds of the patent protection are measured by and defined in the following claims.

We claim:

1. A method for providing three seating positions in a wall-avoiding type reclining chair comprising a frame, at least one arm, a transverse front panel, a seat having a seat cushion and a seat back having a "T" shaped back cushion with lateral wings, comprising the steps of:

beginning with the chair in the first, closed position;

moving the chair toward the second, TV position, by rotating and extending at least a portion of the transverse panel forward relative to the seat, so as to provide a raised leg rest and moving the seat and the seat back in a forward direction relative to the frame; and moving the chair toward the third, reclining position, by rotating the seat back about a transverse axis so that the upper end of the seat back moves in a rearward direction, while further coordinating movement of the seat and seat back, so that the seat back upper end does not move rearward of the most rearward point of the seat back upper end when the chair is in the first, closed position, and wherein lower edges of the lateral wings of the T-cushion are maintained at substantially the same elevation in moving between the first, second and third positions so that deformation of the "T" shaped back cushion is substantially avoided.

2. The method of claim 1 wherein the step of moving the chair into the reclining position further comprises elevating the seat to substantially avoid deformation of the "T" shaped back cushion.

3. The method of claim 2, wherein the step of moving the chair into the third, reclining position, further comprises elevating the seat approximately one inch or more, to substantially avoid deformation of the "T" shaped back cushion.

4. The method of claim 1 and further comprising the steps of:

applying a first operating force to implement the step of moving the chair into the second, TV position; and applying a second operating force to implement the step of moving the chair into the third, reclining position, the second operating force being significantly greater than the first operating force;

the significant variation in the first and second operating forces at approximately the second, TV position, without reliance on a mechanical stop to cause the variation.

5. The method of claim 1, and further comprising the steps of:

operatively connecting a linear actuator to move the seat, forward and back, the actuator having a retracted length to place the chair in the first, closed position;

extending the actuator to an intermediate length to place the chair in the second, TV position; and extending the actuator to an extended length to place the chair in the third, reclining position.

6. The method of claim 1, wherein throughout movement between the three positions, the seat back does not move rearward of the most rearward point of the chair in the first position.

7. The method of claim 6, wherein throughout the movement between the three positions, the chair frame does not move in a forward or rearward direction relative to an underlying surface supporting the chair.

8. The method of claim 7, further comprising the step of utilizing the frame to support the seat and seat back on an underlying surface.

9. The method of claim 6, further comprising the step of positioning a back panel comprising a portion of the chair frame in a stationary position rearward of the seat back.

10. The method of claim 6, further comprising the steps of: forming exterior side and rear surfaces of the chair from the frame; and maintaining the relative positions of such surfaces during movement of the chair between the three positions, to avoid forming or varying the size or shape of any gaps or other discontinuities in the exterior surface.

11. The method of claim 10, further comprising the step of utilizing the frame to support the seat and seat back on an underlying surface.

12. The method of claim 10, wherein the exterior side and rear surfaces extend along substantially the entire length of the chair sides and back and are joined at their lines of intersection to form corners of a box frame.

13. The method of claim 1, wherein the step of moving the chair into the third, reclining position, further comprises elevating the seat to support the back cushion to substantially avoid deformation of at least one wing of the "T" shaped back cushion.

14. The method of claim 13, wherein the step of moving the chair into the third, reclining position, further comprises maintaining substantially the same distance between the back cushion wing and the area of contact of the back cushion with the seat cushion to substantially avoid deformation of the wing by an arm of the chair.

15. The method of claim 1, wherein the step of moving the chair into the third, reclining position, further comprises elevating the seat as the seat back is rotated.

16. The method of claim 1, wherein the step of moving the chair into the third, reclining position, further comprises rotating the seat back about an axis extending transversely across the chair and positioned above the seat, thereby causing forward movement of the upper end of the seat back in addition to rotation.

17. The method of claims 16, wherein the step of moving the chair into the third, reclining position, further comprises rotating the seat back about an axis positioned above the seat to maintain substantially the same distance between the back cushion wing and the area of contact of the back cushion with the seat cushion to substantially avoid deformation of the wing by an arm of the chair.

18. The method of claim 1, wherein the position of the axis about which the seat back is rotated moves higher above the seat as the chair approaches the third, reclining position, thereby causing progressively greater forward movement and progressively less backward movement of the upper end of the seat back.

19. A method for providing three seating positions in a wall-avoiding type reclining chair having a transverse front panel, arms, a seat having a seat cushion and a seat back, and a frame comprising side panels and a rear panel, a portion of the rear panel being directly behind an upper portion of the seat back, comprising the steps of: placing the chair in the first, closed position; moving the seat forward to a second position to implement rotation and extension of at least a portion of the transverse panel forward relative to the seat and provide a leg rest that is substantially in the plane of the seat cushion, thereby placing the chair in the second, TV position; and moving the seat forward to a third position to implement rotation of the seat back downwardly, about a transverse axis, located so that the forward movement of the seat exceeds the rearward movement of the seat back upper end, thereby placing the chair in the third, reclining position.

20. The method of claim 19 and further comprising the steps of: applying a first operating force to implement the first step of moving; and applying a second operating force to implement the second step of moving, the second operating force being significantly greater than the first operating force so as to clearly define the second, TV position without reliance on any other mechanical stop.

21. The method of claim 19 and further comprising the steps of: operatively connecting a linear actuator to move the seat, forward and back, the actuator having a retracted length suitable to placing the chair in a first, closed position; extending the actuator to an intermediate length so as to place the chair in the second, TV position; and extending the actuator to an extended length so as to place the chair in the third, reclining position.

22. The method of claim 19 wherein the step of moving the seat forward to the third position also includes elevating the seat approximately one inch or more to substantially avoid deformation of the "T" shaped back cushion.

23. Apparatus for providing three seating positions in a wall-avoiding type reclining chair having a front panel, arms, a seat with a seat cushion and a seat back, and a "T" shaped back cushion, comprising: an exterior frame having parallel, spaced apart right and left hand longitudinal sides and an undivided, substantially vertical and rectangular rear panel directly behind an upper portion of the seat back; a seat support assembly mounted within the exterior frame by four-bar linkages for front to rear movement with respect thereto; an extensible leg rest linkage operably attached to the seat support assembly and to the exterior frame, for forward extension with respect to both, and operable by a first forward movement of the seat support assembly from a first position to a second position relative to the exterior frame; and a seat back guiding linkage operably attached to the seat support assembly and to the exterior frame and actuated by a second forward movement of the seat support assembly from the second position to a third position relative to the exterior frame to rotate the seat back downwardly within the exterior frame sides and rear panel.

24. Apparatus for a reclining chair according to claim 23 and further comprising a linear actuator operably connected to the seat support assembly, the actuator having a retracted length, to place the seat support assembly in the first position, an intermediate length, to place the seat support assembly in the second position, and an extended length, to place the seat support assembly in the third position.

25. Apparatus for a reclining chair according to claim 23 and further comprising: an arm mounted atop each longitudinal side; and the seat support assembly being guided to elevate approximately one inch or more in conjunction with the second forward movement of the seat support assembly from the second position to the third position so as to allow unobstructed forward movement of the "T" shaped back cushion.

26. The apparatus according to claim 23, and further comprising: a first force to move the seat support members from the first position to the second position; a second force to move the seat support members from the second position to the third position; and the second force being substantially greater than the first force, so that no discreet motion stop is required to define the second position.

27. Apparatus for a reclining chair according to claim 23 wherein the seat back guiding linkage guides the seat back to rotate about a transverse, axis, with forward movement of the seat back such that the seat back upper end does not move rearwardly.

28. The apparatus according to claim 23, wherein the seat four-bar linkage mounting moves the seat support assembly upwardly as the seat back guiding linkage rotates the seat back downwardly, so as to elevate the "T" shaped back cushion and prevent binding contact between the "T" shaped back cushion and the arms.

* * * * *